United States Patent [19]

Pauza et al.

[11] Patent Number: 4,861,284

[45] Date of Patent: Aug. 29, 1989

[54] SWITCH ACTIVATING PLUG FOR A COAXIAL CONNECTOR

[75] Inventors: William V. Pauza, Palmyra; Wilmer L. Sheesley, Dauphin, both of Pa.

[73] Assignee: AMP Incorporated, Harrisburg, Pa.

[21] Appl. No.: 181,458

[22] Filed: Apr. 14, 1988

[51] Int. Cl.[4] ..... H01R 17/04

[52] U.S. Cl. ..... 439/580; 439/470; 439/603

[58] Field of Search ..... 439/578–585, 439/746–749, 872, 675, 470, 603

[56] References Cited

U.S. PATENT DOCUMENTS

| | | | |
|---|---|---|---|
| 2,180,923 | 11/1939 | Del Camp | 439/578 |
| 3,513,438 | 5/1970 | Henschen et al. | 439/746 |
| 3,775,728 | 11/1973 | Pitacco | 439/747 |
| 4,628,159 | 12/1986 | Deitch et al. | 200/51.05 |
| 4,666,231 | 5/1987 | Sheesley et al. | 439/581 |
| 4,749,355 | 6/1988 | Hemmer | 439/675a |

*Primary Examiner*—Neil Abrams

[57] ABSTRACT

A switch activating plug 10 comprises a housing 12, an inner conductor 17, an intermediate conductor 18 spaced apart from the inner conductor 17, and a dielectric member 19 supporting the inner and intermediate 17,18 conductors. The dielectric member 19 is construed with axial cavities 88,92 for slidable assembly with the conductive parts of the inner and intermediate conductors 17,18 and in such manner that the inner and intermediate conductors 17,18 are maintained by the dielectric member 19 in electrical isolation from one another. The inner conductor 17 comprises a shaft 58 having a contact head 60 at one end and a terminal 62 at another end. The inner conductor 17 further comprises a flange 66 along the shaft 58 and an offset portion 64 of the shaft 68 spaced from the flange 66. Upon slidable assembly with the dielectric member 19, the flange 66 prevents movement of the inner conductor 17 in one direction, while the offset portion 64 of the shaft 58 prevents movement in an opposite direction, relative to the dielectric member 19. The intermediate conductor 18 includes a cantilevered lancet 80 projecting toward the dielectric member 19. Upon assembly with the dielectric member 19, the cantilevered lancet 80 abuts against an edge 96 of the dielectric member 19 to prevent further slidable movement of the intermediate electrical conductor 18 relative to the dielectric member 19.

13 Claims, 5 Drawing Sheets

SWITCH ACTIVATING PLUG FOR A COAXIAL CONNECTOR

FIELD OF THE INVENTION

The invention relates to a coaxial electrical connector, and more particularly, to a coaxial plug which mates with a coaxial jack. The jack includes two internal electric switches which are activated upon mating with the plug.

BACKGROUND OF THE INVENTION

U.S. Pat. No. 4,666,231, assigned in common with the present application, discloses a coaxial jack which is constructed for slidable assembly. The jack disclosed therein includes an inner contact, an intermediate contact, and a disconnect switch with switch pole contacts. Upon insertion of an insulative sleeve into the jack, the disconnect switch is activated.

In U.S. Pat. No. 4,628,159, a jack adapted for mounting on a printed circuit board and a plug for mating with the jack are disclosed. The jack includes a housing and a plurality of contacts for conducting electrical current. An insulating member is provided to support the contacts and to insulate them from each other. The jack further includes a switching mechanism for switching between a pair of the conducting contacts.

The plug of U.S. Pat. No. 4,628,159 is used for connecting shielded, twisted pair cable to the jack. The plug includes a housing, a central conductor, an intermediate conductor, and a dielectric member supporting and separating the two conductors. The dielectric member projects beyond the end of the housing. When inserted into the jack, the central conductor and the intermediate conductors of the plug engage corresponding contacts of the jack. At the same time, the dielectric member activates the switching mechanisms in the jack.

The central conductor of the plug described in U.S. Pat. No. 4,628,159 comprises a thin shaft and a cylindrical enlargement or gland with a flat side along the shaft. This central conductor is difficult to manufacture. In order to form the central conductor, it is necessary to start with a large piece of material due to the size of the gland. Moreover, several operations are necessary to form the central conductor. It is necessary to first draw out the shaft portion of the central conductor. The cylindrical gland is next formed by screw machining or some other turning process. The flat side of the gland is then formed by a final machining process.

The dielectric member of the plug described in U.S. Pat. No. 4,628,159 is also difficult to manufacture. It comprises a generally cylindrical body having an axial passage for receiving the central conductor, and a pair of circumferential inner passageways for receiving spaced apart contact members of the intermediate conductor. The dielectric member further includes a resilient arm. When the plug is mated with the jack, a portion of the jack forces the arm downward. The arm engages an edge of the intermediate conductor thereby locking the intermediate conductor in place.

The dielectric member is formed from a thermoplastic material in an injection molding process. The main body of the dielectric member is formed by pulling the mold in a single direction. However, in order to form the latching arm, it is necessary to pull the mold in a second direction, i.e., side action is required. This makes the manufacture of the dielectric member more difficult than it should be. Furthermore, the design of the dielectric member is not entirely satisfactory because it is undesirable to lock a metallic member, i.e., the intermediate conductor, in place by pressing an insulating material against a metallic piece. It is much more desirable, because of its strength, to provide a metallic arm which presses against an edge of the dielectric member.

Accordingly, it is an object of the invention to provide a switch activating plug having an inner conductor, an intermediate conductor, and a dielectric member which are adapted for slidable interengagement, wherein the inner conductor does not have an enlarged gland.

It is a further object of the invention to provide such a plug wherein the dielectric member does not include a resilient latching arm for locking the intermediate conductor in place.

It is a further object of the invention to provide such a plug wherein the dielectric member extends beyond the housing of the plug to activate a switch when the plug is mated with a jack.

It is yet another object of the invention to provide such a plug wherein the inner conductor, the intermediate conductor, and the dielectric member can be produced by simple, inexpensive manufacturing processes.

SUMMARY OF THE INVENTION

An embodiment of the present invention includes a plug comprising a housing, an inner conductor, an intermediate conductor spaced apart from the inner conductor, and a dielectric member supporting the inner and intermediate conductors. The dielectric member is constructed with axial cavities for slidable assembly with the conductive parts of the inner and intermediate conductors and in such manner that the inner and intermediate conductors are maintained by the dielectric member in electrical isolation from one another.

An aspect of the invention resides in the inner conductor comprising a shaft having a contact head at one end and a terminal at another end. The inner conductor further comprises a flange along the shaft and an offset portion of the shaft spaced from the flange. Upon slidable assembly with the dielectric member, the flange prevents movement of the inner conductor in one direction, while the offset portion of the shaft prevents movement in an opposite direction, relative to the dielectric member.

Another aspect of the invention resides in that the intermediate conductor includes a cantilevered lancet projecting toward the dielectric member. Upon assembly with the dielectric member, the cantilevered lancet abuts against an edge of the dielectric member to prevent further slidable movement of the intermediate electrical conductor relative to the dielectric member.

An advantage of the present invention is that the inner electrical conductor does not include the enlarged gland of U.S. Pat. No. 4,628,159. Thus, the inner conductor of the present invention can be produced by a simple process from a wire roll of metallic material. It is much easier to manufacture than the central conductor of U.S. Pat. No. 4,628,159.

Another advantage of the present invention is that the dielectric member does not include a resilient latching arm which is forced downward upon assembly to abut against the intermediate electrical conductor. Thus, the dielectric member of the present invention is also much easier to manufacture than that of U.S. Pat. No. 4,628,159.

Another advantage of the present invention is that a cantilevered lancet projects away from the intermediate conductor to abut against an edge of the dielectric member thereby preventing slidable movement of the intermediate conductor relative to the dielectric member. This is a more desirable design feature than the resilient latching arm of the dielectric member disclosed in U.S. Pat. No. 4,628,159.

Other advantages of the invention will be apparent from the detailed description and the accompanying drawings that together disclose by way of example the aspects of the invention.

Figure 1:
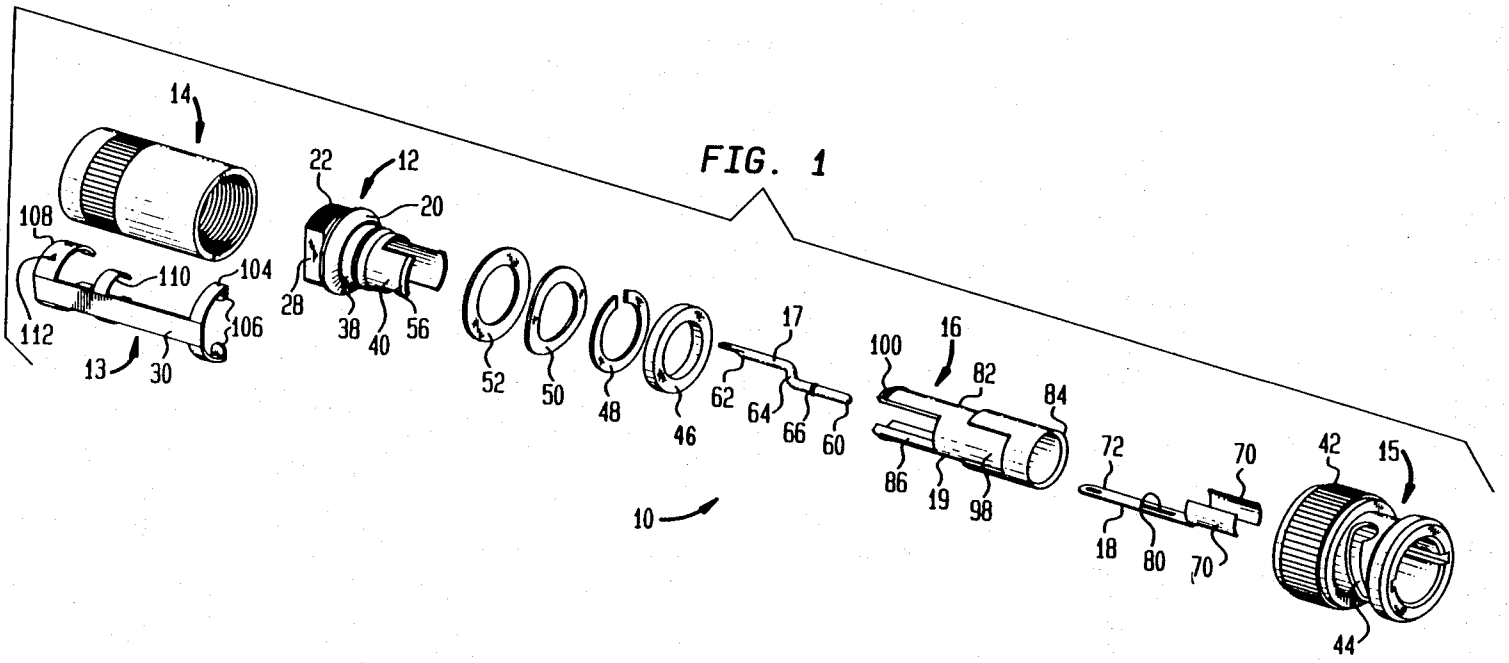
FIG. 1 is a perspective view of a switch activating plug of the present invention with the parts illustrated in exploded configuration.

With more particular reference to the drawings, an inventive plug 10 according to an embodiment of the invention includes a housing 12 to which a clamp shield 13 and a cover 14 are connected at one end, and a bayonet locking assembly 15 of conventional construction is attached at an opposite end. For purposes of clarity, the end of plug 10 having the bayonet locking assembly 15 will be referred to as the front or forward end, while the end having cover 14 will be referred to as the back or rear end. Plug 10 further includes a conductive assembly 16 which fits within housing 12. Assembly 16 comprises an inner electric conductor 17, an intermediate electrical conductor 18, and a dielectric member 19 which receives both conductor 17 and conductor 18 in separate passageways and insulates them from each other.

Figure 2:
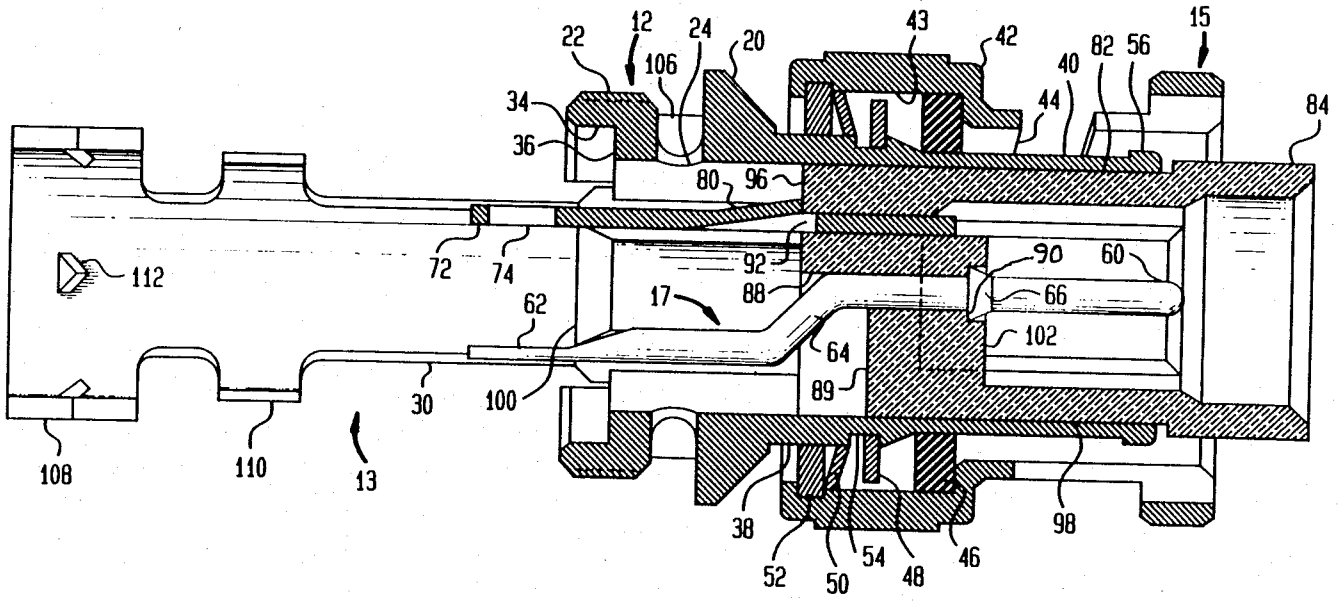
FIG. 2 is a sectional view of the assembled plug illustrated in FIG. 1.

With more particular reference to FIGS. 1 and 2, housing 12 includes a frusto-conical central portion 20 and an externally threaded cylindrical portion 22 extending rearwardly from central portion 20. The threaded cylindrical portion 22 is spaced apart from the base of the conical portion 20 by a circumferential groove 24. A pair of approximately opposing radial openings (not shown) are located in groove 24. A flattened cutaway surface 28 (see FIG. 1) is provided on one side of threaded portion 22. The flat cutaway surface 28 provides a region for receiving a connecting bridge 30 of clamp shield 13 without interfering with the threading of cover 14 onto housing 12.

Housing 12 includes an axial passageway 32 which extends completely through housing 12. Axial passageway 32 is of substantially constant diameter except near the rear end of housing 12 and beneath threaded portion 22, where axial passageway 32 is enlarged as shown at 34 so as to form a radial shoulder 36 between the two different diameter portions of axial passageway 32. Extending forwardly from conical portion 20 of housing 12 is a cylindrical sleeve 38. Extending forwardly from sleeve 38 are a pair of legs 40 which engage with intermediate conductor 18 as will be discussed hereinbelow.

Bayonet locking assembly 15 holds plug 10 in engagement with a jack. Bayonet lock assembly 15 includes a collar 42 having a camming slot 44 for receiving protrusions from the jack with which plug 10 will mate. Collar 42 includes an enlarged passageway 43 which receives within it cylindrical sleeve 38 of housing 12; however, collar 42 remains spaced circumferentially from sleeve 38. In the space between collar 42 and cylindrical sleeve 38 are rubber gasket 46, split retaining ring 48, bent spring washer 50, and flat washer 52. Cylindrical sleeve 38 includes a circumferential slot 54 adapted for receiving split retaining ring 48.

Legs 40 of cylindrical sleeve 38 include an outwardly extending collar 56 at their forward ends. The region between slot 54 and collar 56 of cylindrical sleeve 38 is sloped downwardly so as to minimize friction when plug 10 is mated with the jack. As is well known to those skilled in the art, upon engagement of bayonet locking assembly 15 with a jack, spring washer 50 will exert pressure on the protrusions in camming slot 44, thus locking plug 10 together with the jack.

Figure 4A:
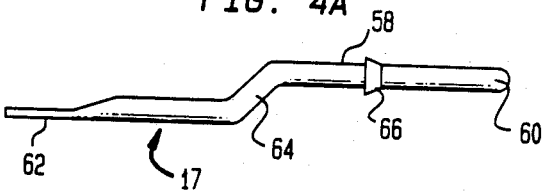
FIG. 4A is an enlarged side view of an inner electrical conductor of the plug illustrated in FIGS. 1 and 2.
Figure 4B:
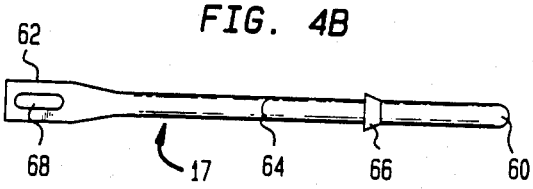
FIG. 4B is an enlarged top view of an inner electrical conductor of the plug illustrated in FIGS. 1 and 2.

As mentioned above, conducting assembly 16 comprises an inner conductor 17, an intermediate conductor 18, and a dielectric member 19 which receives both conductors and insulates them from each other. As best seen in FIGS. 4A and 4B, inner conductor 16 comprises an elongated shaft 58 having a contact head 60 at one end thereof and a terminal 62 at an opposite end thereof. Inner conductor 17 further includes an offset portion 64 about halfway along shaft 58 and a flange 66 about halfway between offset portion 64 and the tip of contact head 60. As illustrated in FIGS. 4A and 4B, offset portion 64 is angulated while flange 66 is an annular diverging flange. Alternatively, the offset portion 64 may be vertical while flange 66 may comprise a pair of oppositely disposed projections (see FIG. 7). At its terminal end 62, inner conductor 17 is flattened and has an aperture 68 for receiving a wire. Terminal 62 is designed for soldering a wire from a coaxial cable to inner conductor 17.

Figure 3A:
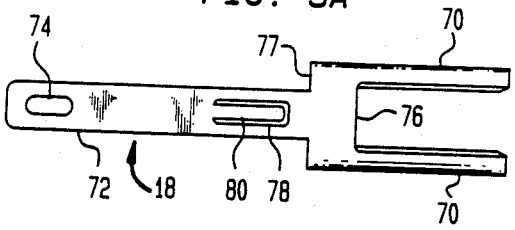
FIG. 3A is an enlarged top view of an intermediate electrical conductor of the plug illustrated in FIGS. 1 and 2.
Figure 3B:
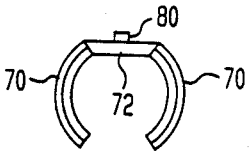
FIG. 3B is an enlarged end view of an intermediate electrical conductor of the plug illustrated in FIGS. 1 and 2.
Figure 3C:
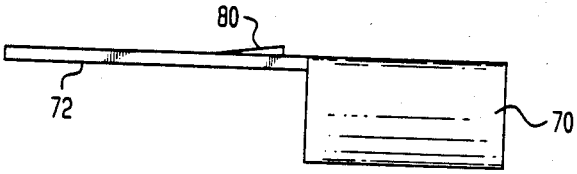
FIGS. 3C is an enlarged side view of an intermediate electrical conductor of the plug illustrated in FIGS. 1 and 2.

Referring now to FIGS. 3A, 3B, and 3C, intermediate conductor 18 includes a pair of spaced apart contact legs 70 at a forward end thereof and a flattened terminal 72 at a rear end thereof. Terminal 72 also includes an aperture 74 for receiving a wire for soldering. Contact legs 70 are curved with a radius of curvature approximately equal to an imaginary cylinder of which they form a part. Legs 70 are designed so as to curve about contact head 60 while being separated therefrom when inner central conductor 17, intermediate conductor 18, and dielectric member 19 are assembled together. Contact legs 70 are held apart by the width of terminal member 72. The forwardmost end of terminal 72 forms an edge 76 extending between contact legs 70. Each of legs 70 terminates in an edge 77. Terminal 72 also includes along its body a second aperture 78. A resilient lancet 80 which is held in cantilevered fashion in aperture 78 extends out of the plane of terminal 72, in this case, upwardly.

Contact legs 70 are approximately one-third the length of terminal 72. Intermediate conductor 18 is approximately the same length as inner conductor 17. Both inner conductor 17 and intermediate conductor 18 terminate at approximately the forward end of housing 19 when installed.

Figure 5A:
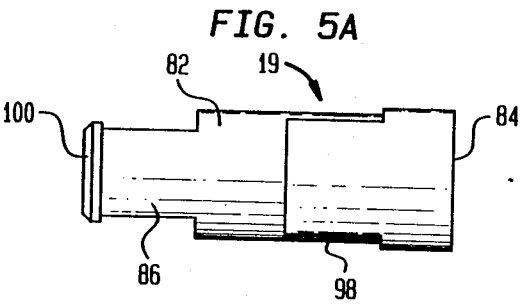
FIG. 5A is an enlarged side view of the dielectric member of the plug illustrated in FIGS. 1 and 2.
Figure 5B:
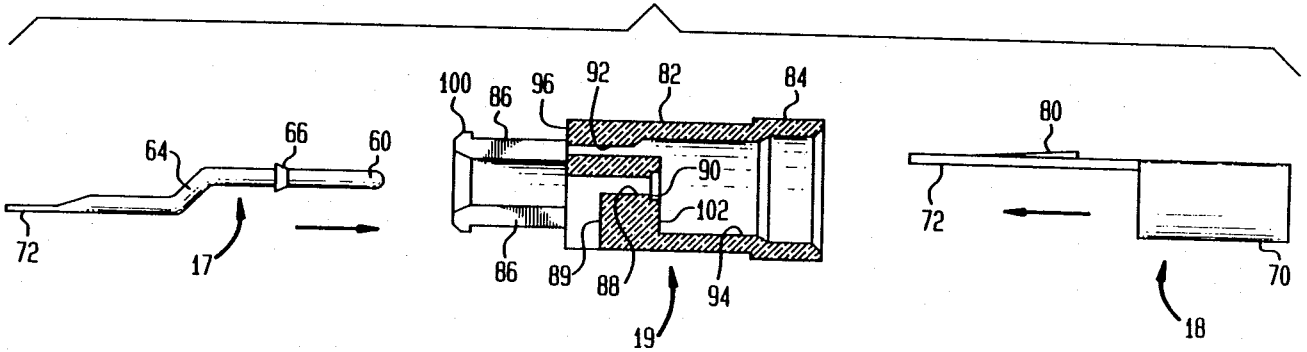
FIG. 5B is a side view of the two electrical conductors and a dielectric member ready for assembly with the dielectric member illustrated in section.

Referring now to FIGS. 5A and 5B, dielectric member 19 is generally a cylindrical body and is formed to be received in axial passageway 32 of housing 12. Dielectric member 19 includes a central body 82, a cylindrical sleeve 84 extending from one end of body 82 in the forward direction and a pair of opposing arms 86 extending from body 82 in a rearward direction. Sleeve 84 is of slightly larger outside diameter than body 82. Central body 82 includes a first axial passageway 88 for receiving contact head 60 of inner conductor 17 from a rear direction. At the rear side of passageway 88, there is a radial edge 89, while at the forward edge of passageway 88 there is a radial shoulder 90 followed by a radial edge 102. Shoulder 90 is designed to abut against the diverging side of annular flange 66 after inner conductor 17 has been inserted into passageway 88 from the rear.

In the inner region of body 82, on the inside of sleeve 84, there is a groove 94 in body 82 travelling around the entire circumference along the inside of body 82. The groove is shaped to receive the radially curved contact legs 70 of the intermediate conductor 18 in the region where contact legs 70 are connected to terminal member 82. In addition, a passageway 92 extends axially through body 82. Passageway 92 is designed for the purpose of receiving the flat terminal member 72 and is therefore rectangular. Intermediate contact 18 is inserted into dielectric member 19 from a forward direction as shown in FIG. 5B. As terminal member 72 passes through passageway 92, cantilevered lancet 80 is pressed downward. After cantilevered lancet 80 traverses passageway 92, it pivots upward by resilient spring action and abuts against a radial shoulder 96 of central body 82 (see FIG. 2).

The outer surface of sleeve 84 has a pair of oppositely disposed portions 98 (FIG. 1) of reduced outer diameter extending forwardly from body 82 to near the forward end portion of sleeve 84. Recessed portions 98 are designed to receive legs 40 of housing 12 thereby preventing dielectric member 19 from rotating with respect to housing 12.

Arms 86 extend rearwardly from body 82 of dielectric member 19. Arms 86 include radially outwardly extending collars 100 at the end of arms 86. Collars 100 engage radial shoulder 36 of housing 12 to hold dielectric member 19 securely in housing 12.

To assemble plug 10 together, the components of assembly 16 are first slidably interengaged. As shown in FIG. 5B, central conductor 17 is inserted from the back of dielectric member 19 toward the front. Contact head 60 is inserted through axial passageway 88 in dielectric member 19. Inner conductor 17 is oriented so that the front portion of terminal 62 is transverse to arms 86 of dielectric member 19. Inner conductor 17 is inserted until annular flange 66 squeezes through passageway 88 and then engages shoulder 90 with its diverging side. The engagement of annular flange 66 wit radial edge 90 prevents retraction of inner conductor 17. Once annular flange 66 traverses passageway 88, a forward edge of offset portion 64 engages radial edge 89. The abutment of offset portion 64 against radial edge 89 prevents inner conductor 17 from being inserted any further into dielectric member 19.

Next, intermediate conductor 18 is inserted from the front end of dielectric member 19 toward the rear end. Terminal member 72 is passed through rectangular passageway 92 and contact legs 70 are pressed into the curved groove 94 in the front of body 82. After the cantilevered lancet traverses passageway 92, it projects upward and comes into contact with radial shoulder 96, thus preventing retraction of intermediate conductor 18 from dielectric member 19. At about the same time, the edge 77 comes into contact with radial edge 102 thus preventing insertion of intermediate conductor 18 into dielectric member 19.

Assembly 16 is then inserted from the front into housing 12. Because of collars 100, arms 86 are compressed by the inner wall defining axial passageway 32 of housing 12 so that dielectric member 19 may be slid through passageway 32. Dielectric member 19 is oriented so that legs 40 of housing 12 slide into recessed areas 98 on the outside of dielectric member 19. Dielectric member 19 continues to slide into passageway 32 until arms 86 flex outwardly and collars 100 engage radial edge 36. The engagement of collars 100 with edge 36 prevents dielectric member 19 from moving forwardly, while legs 40 in recessed areas 98 prevent dielectric member 19 from moving rearwardly or rotationally with respect to housing 12.

Clamp shield 13 is attached to the circumferential groove 24 which has openings (not shown) therein. Clamp shield 13 includes a semi-cylindrical strap 104 having legs 106 at the ends thereof. Legs 106 are inserted into the openings of groove 24. Connecting bridge 30 is connected at one end to the strap 104 and at its other end to curved members 108 and 110. Curved member 108 include barbs 112 to retain a cable therein and to relieve tension from solder joints at terminal members 62 and 72. The ends of curved member 110 may also be used to solder the braid of a coaxial cable to clamp shield 13. This further aids in retaining a cable in clamp shield 13 and to relieve tension from the solder joints at terminals 62 and 72.

Cover 14 is cylindrically shaped with one open end and one partially closed end (not shown) to allow for passage therethrough of a cable. Cover 14 has an internal threading 114 for attachment to the external threads of housing 12. Cover 14 provides a protective covering between housing 12 and the cable to protect the conductive connections at terminals 62 and 72.

Figure 6:
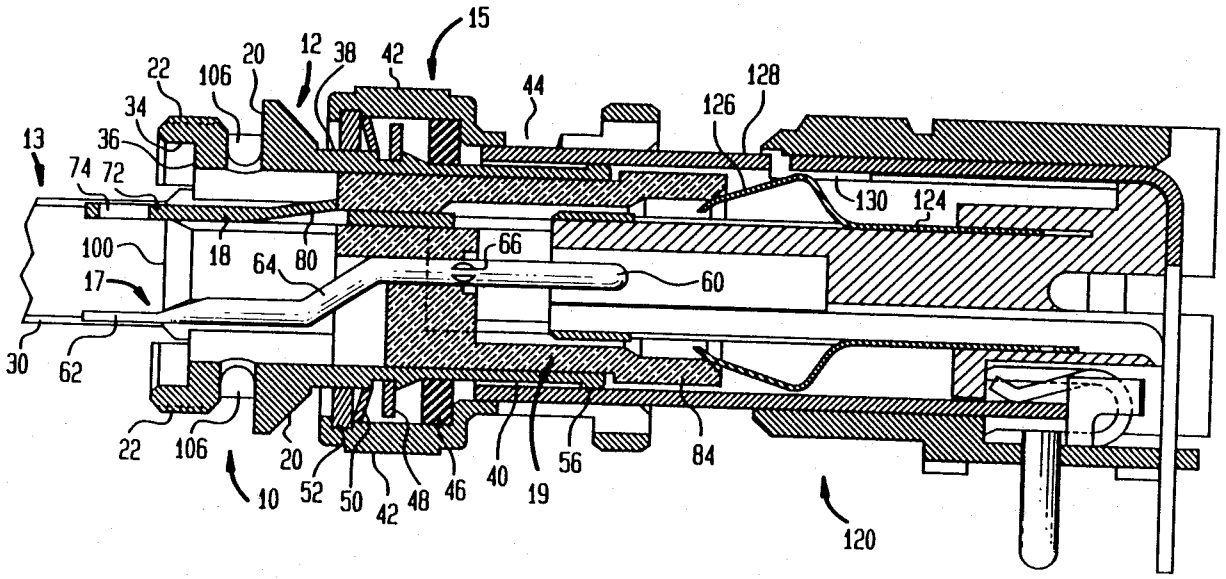
FIG. 6 is a sectional view of the plug illustrated in FIGS. 1 and 2 connected with a jack having a switching mechanism.

Sleeve 84 of dielectric member 19 extends beyond the forward edge of housing 12. Plug 10 is designed to mate with a jack which includes a switch, for example, a disconnect switch. The switch is activated by sleeve 84 as it is inserted into the jack. Referring now to FIG. 6, plug 10 is illustrated as it is being inserted into a jack 120. Jack 120 is substantially of the same design as the jack disclosed in the previously mentioned U.S. Pat. No. 4,666,231, which includes a disconnect switch with switch pole contacts. Jack 120 includes an inner contact 122, an intermediate contact 124 in the form of a tubular shell with elongated springs 126, and an outer conductor shell 128. Jack 120 further includes switch pole contact 130 normally in contact with one of springs 126 and another switch pole contact (not shown) in contact with the other spring 126. Upon insertion of plug 10 into jack 120, sleeve 84 deflects springs 126 away from the switch pole contacts. At the same time, the inner conductors and the intermediate conductors of plug 10 and jack 120 engage each other. Upon removal of plug 10, springs 126 reengage their respective switch pole contacts. For further details regarding jack 120 reference is made to U.S. Pat. No. 4,666,231 which is incorporated herein by such reference.

It will be observed that inner conductor 17 described herein does not include the enlarged gland of U.S. Pat. No. 4,628,159. Inner conductor 17 may be formed by drawing from a wire after which the smaller features of inner conductor 17, such as the flange 66 and the terminal 62 are hammered or cold headed into the inner conductor. Thus, it is much easier to manufacture than the inner conductor of U.S. Pat. No. 4,628,159. It will further be observed that dielectric member 66 does not include a resilient latching arm as does the dielectric member of U.S. Pat. No. 4,628,159. Instead, the dielectric member is a simpler piece which can be produced by injection molding with pulling in one direction only. There is no need for side action. A cantilevered lancet 80 of the intermediate conductor 18 abuts against a radial edge of dielectric member 19 in order to prevent relative motion.

The aspects of the invention have been described and illustrated only by way of the example, and may be embodied in further examples intended to be in and of the spirit and scope of the claims.

We claim:

1. An electrical plug with coaxial mating regions for engaging a corresponding connector, comprising a housing having a longitudinal axis, an inner conductor, an intermediate conductor, and a dielectric member for supporting said inner and intermediate conductors in said housing and for separating said inner and intermediate conductors from each other, said dielectric member including a first axial passageway for slidably receiving said inner conductor and a second axial passageway for slidably receiving said intermediate conductor, said inner conductor comprising an elongated shaft and including a flange and a slanted central region along said elongated shaft, said flange coming into contact with a first edge region of said dielectric member when said inner conductor is moved in a first axial direction and said slanted central region of said shaft coming into contact with a second edge region of said dielectric member when said inner conductor is moved in an opposite axial direction thereby to prevent axial movement of said inner conductor, said intermediate conductor including projecting means which abuts against a third edge region of said dielectric member to prevent movement of said intermediate conductor in an axial direction.

2. The plug of claim 1 wherein said projecting means comprises a cantilevered lancet.

3. The plug of claim 1 wherein said intermediate conductor comprises a pair of contact legs at one end and a flat terminal at another end, said projecting means extending out of the plane of said flat terminal.

4. The plug of claim 1 wherein said dielectric member includes a sleeve extending beyond said housing.

5. The plug of claim 1 wherein said inner conductor further comprises a contact head and a flat terminal.

6. The plug of claim 5 wherein said flange comprises an annular flange, said flange including a diverging side which abuts against said first edge region.

7. The plug of claim 1 further including a bayonet locking assembly connected to said housing.

8. The plug of claim 1 further including a cover for said housing.

9. The plug of claim 1 wherein said housing includes axially projecting legs and said dielectric member includes recessed portions on its outer surface, said legs being received with said recessed portions.

10. A switch activating electrical plug with coaxial mating regions for engaging a corresponding connector, comprising a housing having a longitudinal axis, an inner conductor, an intermediate conductor, and a dielectric member for supporting said inner and intermediate conductors in said housing and for separating said inner and intermediate conductors from each other, said dielectric member including a sleeve projecting beyond said housing for activating a switch when said plug is mated with a jack, said dielectric member including a first axial passageway for slidably receiving said inner conductor and a second axial passageway for slidably receiving said intermediate conductor, said inner conductor comprising an elongated shaft having a contact head at one end and a terminal at another end, said shaft including a flange and a slanted central region spaced apart from said flange, said flange coming into contact with a first inner edge region of said dielectric member when said inner conductor is moved in a first axial direction and said slanted central region of said shaft coming into contact with a second inner edge region of said dielectric member when said inner conductor is moved in an opposite axial direction thereby to prevent axial movement of said inner conductor, said intermediate conductor comprising a pair of contact legs at one end, a terminal at another end, and a cantilevered lancet projecting out of the plane of said terminal, said cantilevered lancet coming into contact with a third inner edge region of said dielectric member to prevent axial movement of said intermediate contact.

11. The plug of claim 10 wherein said flange comprises an annular flange having a diverging side which abuts against said first edge.

12. The plug of claim 10 further including a bayonet locking assembly for locking a jack to said housing.

13. A switch activating electrical plug with coaxial mating regions for engaging a corresponding connector, comprising a housing having a longitudinal axis, an inner conductor made from a metallic material, an intermediate conductor made from a metallic material, and a dielectric member made from a thermoplastic insulating material for supporting said inner and intermediate conductors in said housing and for separating said inner and intermediate conductors from each other, said dielectric member including a sleeve projecting beyond said housing for activating a switch when said plug is mated with a jack, said dielectric member including a first axial passageway for slidably receiving said inner conductor and a second axial passageway for slidably receiving said intermediate conductor, said inner conductor comprising an elongated shaft having a contact head at a first end and a terminal at a second end, said shaft including a flange in the region of said first end, and a slanted central region between said flange and said terminal, said slanted central region forming a transition region in said shaft connecting said first and second ends, said flange coming in contact with a first inner edge region of said dielectric member when said inner conductor is moved in a first axial direction and said slanted central region of said shaft coming into contact with a second inner edge region of said dielectric member when said inner conductor is moved in an opposite axial direction thereby to prevent axial movement of said inner conductor, said intermediate conductor comprising a pair of contact legs at one end, a terminal at another end, and a cantilevered lancet made from a metal projecting out of the plane of said terminal, said cantilevered lancet coming into contact with a third inner edge region of said dielectric member to prevent axial movement of said intermediate contact.

* * * * *